US011047196B2

(12) United States Patent
Rossing

(10) Patent No.: US 11,047,196 B2
(45) Date of Patent: Jun. 29, 2021

(54) PRODUCTION TUBING CONVERSION DEVICE AND METHODS OF USE

(71) Applicant: National Oilwell Varco, L.P., Houston, TX (US)

(72) Inventor: Michael Rossing, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 163 days.

(21) Appl. No.: 16/348,030

(22) PCT Filed: Nov. 9, 2017

(86) PCT No.: PCT/US2017/060787
§ 371 (c)(1),
(2) Date: May 7, 2019

(87) PCT Pub. No.: WO2018/089589
PCT Pub. Date: May 17, 2018

(65) Prior Publication Data

US 2019/0284893 A1 Sep. 19, 2019

Related U.S. Application Data

(60) Provisional application No. 62/419,726, filed on Nov. 9, 2016.

(51) Int. Cl.
*E21B 29/08* (2006.01)
*E21B 33/13* (2006.01)

(52) U.S. Cl.
CPC ..... *E21B 29/08* (2013.01); *E21B 33/13* (2013.01)

(58) Field of Classification Search
CPC ..... E21B 29/08; E21B 33/13; E21B 29/00
See application file for complete search history.

(56) References Cited

U.S. PATENT DOCUMENTS

| | | | | |
|---|---|---|---|---|
| 2,034,768 | A * | 3/1936 | O'Neill | E21B 43/114 166/298 |
| RE21,085 | E * | 5/1939 | O'Neill | E21B 43/114 166/298 |
| 7,537,051 | B1 | 5/2009 | Hall et al. | |
| 8,276,677 | B2 | 10/2012 | Ravensbergen | |
| 2013/0153227 | A1* | 6/2013 | Laird | E21B 31/00 166/301 |

(Continued)

OTHER PUBLICATIONS

European Search Report dated Apr. 22, 2020, for European Application No. 17869872.6 (8 p.).

(Continued)

*Primary Examiner* — Michael R Wills, III
(74) *Attorney, Agent, or Firm* — Conley Rose, P.C.

(57) ABSTRACT

A method includes cutting a production tubing disposed in a wellbore to form a lower production tubing section and an upper production tubing section, displacing the upper production tubing section away from the lower production tubing section, installing a production tubing conversion device within the upper production tubing section, and injecting a sealant into the wellbore through the upper production tubing section, through the production tubing conversion device, and through the bottom hole assembly. The production tubing conversion device is coupled to a bottom hole assembly disposed below the production tubing conversion device.

22 Claims, 10 Drawing Sheets

(56) References Cited

U.S. PATENT DOCUMENTS

| | | | | |
|---|---|---|---|---|
| 2013/0269948 | A1* | 10/2013 | Hoffman | E21B 33/13 166/351 |
| 2014/0231087 | A1 | 8/2014 | Orstad | |
| 2015/0267503 | A1 | 9/2015 | Foong et al. | |
| 2016/0230498 | A1 | 8/2016 | Walton et al. | |

OTHER PUBLICATIONS

PCT/US2017/060787 International Search Report and Written Opinion dated Feb. 12, 2018 (16 p.).

* cited by examiner

PRODUCTION TUBING CONVERSION DEVICE AND METHODS OF USE

CROSS-REFERENCE TO RELATED APPLICATIONS

This application is a 35 U.S.C. § 371 national stage application of PCT/US2017/060787 filed Nov. 9, 2017, and entitled "Production Tubing Conversion Device and Methods of Use," which claims priority to and the benefit of U.S. Provisional Patent application No. 62/419,726 filed on Nov. 9, 2016 and entitled, "Production Tubing Conversion Device and Methods of Use," each of which is incorporated herein in its entirety for all purposes.

SUMMARY

In an embodiment, a method comprises cutting a production tubing disposed in a wellbore to form a lower production tubing section and an upper production tubing section, displacing the upper production tubing section away from the lower production tubing section, installing a production tubing conversion device within the upper production tubing section, and injecting a sealant into the wellbore through the upper production tubing section, through the production tubing conversion device, and through the bottom hole assembly. The production tubing conversion device is coupled to a bottom hole assembly disposed below the production tubing conversion device.

In an embodiment, a method comprises cutting a production tubing disposed in a wellbore to form a lower production tubing section and an upper production tubing section, displacing the upper production tubing section away from the lower production tubing section, installing a production tubing conversion device within the upper production tubing section, milling away a casing section using the section milling tool, injecting a sealant into the wellbore through the upper production tubing section and through the production tubing conversion device, and forming a sealant plug within the wellbore at the location at which the casing section is milled away. The production tubing conversion device is coupled to the section milling tool disposed below the production tubing conversion device.

In another embodiment, a method comprises cutting a production tubing disposed in a wellbore to form a lower production tubing section and an upper production tubing section, displacing the upper production tubing section away from the lower production tubing section, perforating a casing section below the upper production tubing section to form perforations in the casing section, installing a production tubing conversion device within the upper production tubing section, wherein the production tubing conversion device is coupled to a bottom hole assembly disposed below the production tubing conversion device, and injecting a sealant into the wellbore through the upper production tubing section and through the production tubing conversion device, wherein the sealant passes through the perforations in the casing section.

In still another embodiment, a method comprises installing a production tubing conversion device within a production tubing section disposed in a wellbore that is coupled to a bottom hole assembly disposed below the production tubing conversion device, and performing a workover procedure in the bottom assembly coupled to the production tubing conversion device. The production tubing conversion device comprises a central mandrel, one or more seals disposed between the central mandrel and an interior surface of the production tubing section, and one or more slips engaging the interior surface of the production tubing section, wherein the one or more slips are configured to mechanically couple the central mandrel to the production tubing section.

In an embodiment, a workover system comprises a production tubing section disposed in a wellbore, a production tubing conversion device disposed within the production tubing section at or near an end of the production tubing section, and a bottom hole assembly coupled to the production tubing conversion device. The production tubing conversion device comprises a central mandrel, one or more seals disposed between the central mandrel and an interior surface of the production tubing section, and one or more slips engaging the interior surface of the production tubing section. The one or more slips are configured to mechanically couple the central mandrel to the production tubing section, and the bottom hole assembly is mechanically and fluidly coupled to the production tubing section through the production tubing conversion device.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
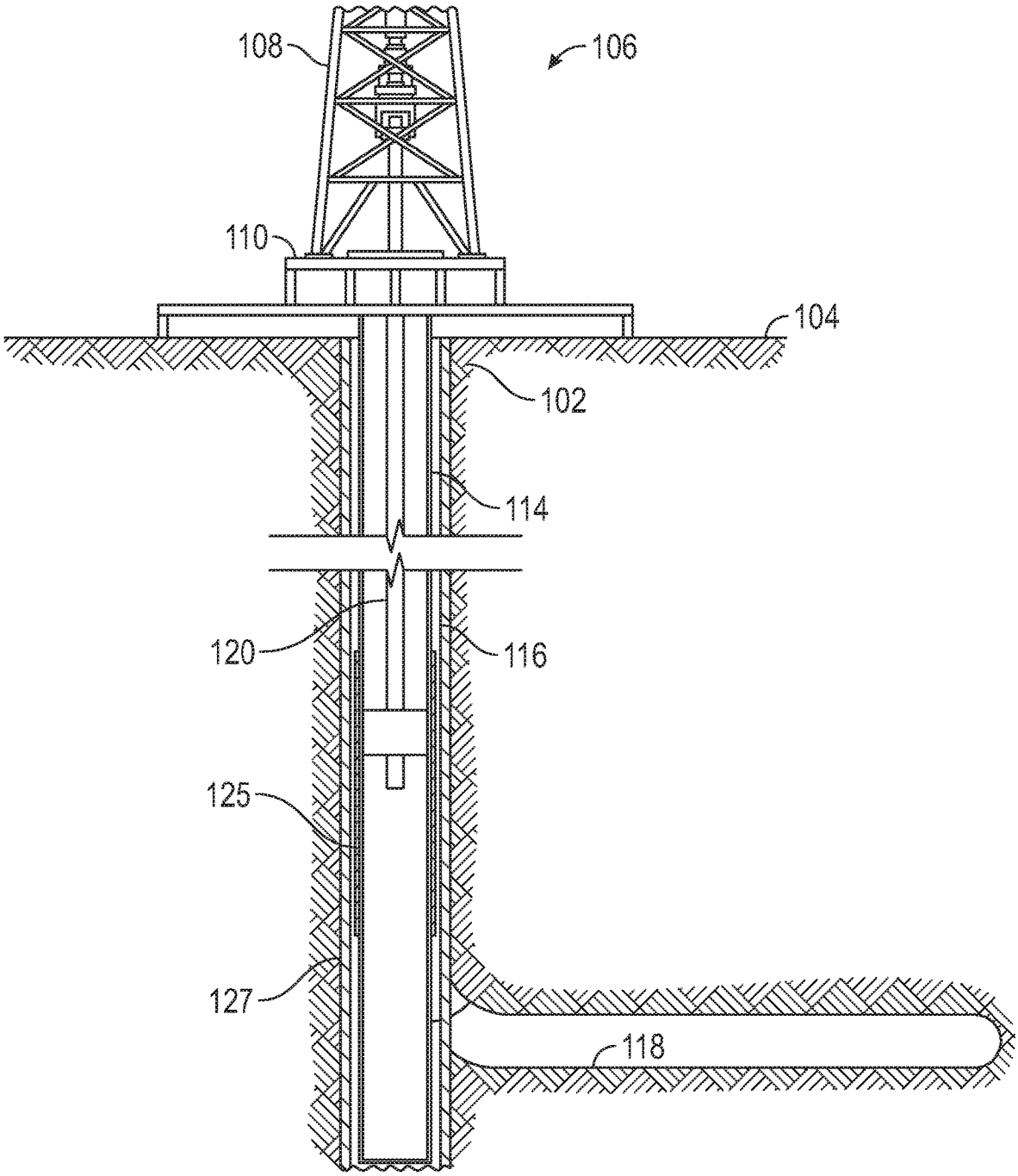
FIG. 1 illustrates a schematic cross-sectional view of an embodiment of a wellbore operating environment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular or tubing and/or wall of the wellbore. Reference to "longitudinal," "longitudinally," or "axially" means a direction substantially aligned with the main axis of the wellbore and/or wellbore tubing. Reference to "radial" or "radially" means a direction substantially aligned with a line between the main axis of the wellbore and/or wellbore tubing and the wellbore wall that is substantially normal to the main axis of the wellbore and/or wellbore tubing, though the radial direction does not have to pass through the central axis of the wellbore and/or wellbore tubing. The various characteristics mentioned above, as well as other features and characteristics described in more detail below, will be readily apparent to those skilled in the art with the aid of this disclosure upon reading the following detailed description of the embodiments, and by referring to the accompanying drawings.

A producing well can have a number of completion configurations, which can include at least a production tubing extending between the production assembly and the surface of the wellbore. The production tubing can be similar to other tubing, and is generally intended to provide a sealed fluid communication pathway between the completion assembly or completion assemblies and the surface. In order to perform various services on the wellbore, the production tubing can be removed, and a variety of tools can be used with a workover tubing or workover string to perform the services. The removal of the production tubing can require a relatively heavy lifting rig, which can be expensive and consume valuable resources.

Disclosed herein are systems and methods that allow for various workover procedures to be performed without removing the production tubing from the wellbore. As described in more detail herein, the production tubing can be cut or separated above a completion assembly so that the production tubing can be raised while leaving the completion assembly in position. A production tubing conversion device that can be similar to a packer element can be placed at or near the end of the production tubing to allow the production tubing to be used as a workover string. Various tools can be coupled to the production tubing conversion device when it is disposed in the production tubing so that a variety of jobs can be performed using the production tubing. For example, an abandonment procedure or a plug and recompletion procedure can then be performed using the production tubing without ever removing the production tubing from the wellbore.

Such a system has a number of advantages. First, a heavy lifting rig may not be needed as the production tubing is not removed from the wellbore and the use of a longer workover string of workover tubing is avoided. Rather, a lighter workover rig can be used to raise the production tubing once it is separated. In addition, the production tubing conversion device can be installed in the production tubing using a wireline, slick line, or coiled tubing, which do not require complicated workover rig operations to use. The production tubing conversion device can also be installed at almost any point within the production tubing, which can provide flexibility in the installation and workover locations. Thus the present systems and methods may provide a lower cost, faster, and more efficient workover procedure for a variety of wellbore operations.

Turning to FIG. 1, an example of a wellbore operating environment in which the present systems and methods can be used is shown. As depicted, the operating environment comprises a workover rig 106 that is positioned on the earth's surface 104 and extends over and around a wellbore 114 that penetrates a subterranean formation 102 for the purpose of recovering hydrocarbons. At least the upper portion of the wellbore 114 may be lined with casing 125 that is cemented into position against the formation 102 using a sealant such as cement 127 in a conventional manner. Alternatively, the operating environment can include an uncased well bore 120.

The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubing string (e.g., a production tubing string, a workover tubing string, etc.) may be lowered into the subterranean formation 102 for a variety of drilling, completion, workover, and/or treatment procedures throughout the life of the wellbore. The embodiment shown in FIG. 1 illustrates the wellbore tubing 120 in the form of a completion string comprising a production tubing disposed within the subterranean formation. In general, production tubing and workover tubing can be somewhat similar. However, production tubing tends to be lighter (e.g., thinner) while also incorporating threads designed to transfer torque from the surface of the wellbore 114 to an end of the workover tubing string. As described herein, the use of the production tubing string to perform a workover may not require a heavy lifting rig as is needed when the production tubing string is removed and replaced with a workover string.

In some embodiments, the workover rig 106 can comprise a derrick 108 with a rig floor 110 through which the wellbore tubing 120 extends downward into the wellbore 114. The workover rig 106 can comprise a motor driven winch and other associated equipment for extending the wellbore tubing 120 into the wellbore 114 to position the wellbore tubing 120 at a selected depth. While the operating environment depicted in FIG. 1 refers to a stationary drilling rig 106 for lowering and setting the wellbore tubing 120 within a land-based wellbore 114, in alternative embodiments, mobile workover rigs, wellbore servicing units (such as coiled tubing units), and the like may be used to lower the wellbore tubing 120 into a wellbore. It should be understood that a wellbore tubing 120 may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the systems and method described here are used, it will be appreciated that the use of the production tubing conversion device can allow the production tubing to be used as a workover string without the need to remove the production tubing string from the wellbore or use a corresponding heavy lifting rig to perform the workover procedure. In some instances, the systems and methods described herein can be used to abandon a wellbore and/or a zone within a wellbore. The use of the production tubing conversion device can then allow the abandonment to be performed quickly and inexpensively.

Figure 2:
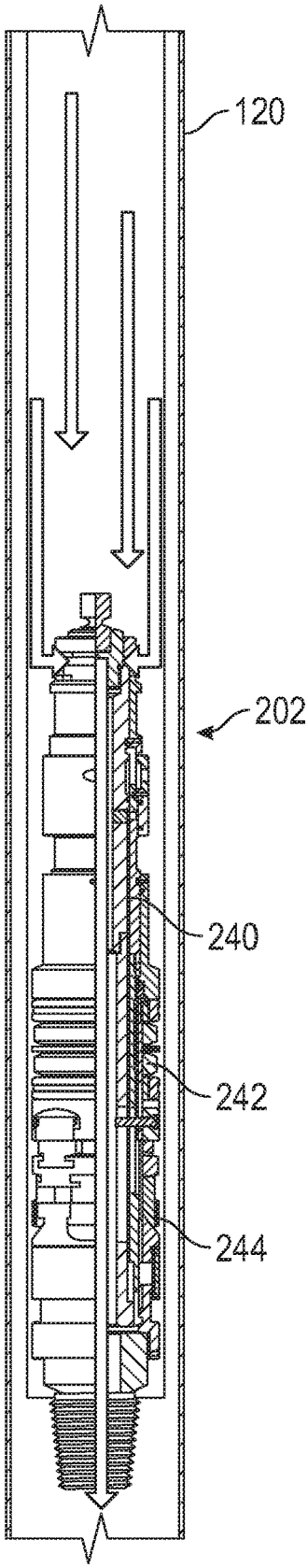
FIG. 2 illustrates a schematic partial cross-sectional view of an embodiment of a production tubing conversion device installed in a production tubing section.

FIG. 2 illustrates an embodiment of a production tubing conversion device 202. The production tubing conversion device 202 can serve to mechanically couple a bottom hole assembly to the production tubing 120. The production tubing conversion device 202 can also serve to establish a flow path through the tubing to one or more bottom hole assemblies and/or an annulus between a casing (or wellbore wall in an open hole completion) and the interior of the production tubing. In some embodiments, the production tubing conversion device 202 can be the same as or similar to a packer set within the production tubing. For example, the production tubing conversion device 202 can be set at or near an end of the production tubing once the production tubing is separated or cut.

While the production tubing conversion device 202 can take a variety of forms, the production tubing conversion device 202 illustrated in FIG. 2 can comprise a central mandrel 240, one or more seal elements 242, and one or more slips 244 or contacts. The central mandrel can comprise a tubing element having a flow path disposed therethrough. An upper end of the central mandrel 240 can have a profile or other connection member to allow a wireline, or coiled tubing to connect to the production tubing conversion device 202 and set the production tubing conversion device 202 within the production tubing 120. The same profile or other connection member can allow a wireline or coiled tubing to connect to the production tubing conversion device 202 and retrieve the production tubing conversion device 202 from the production tubing 120 when it is set. In some embodiments, the central mandrel can comprise two or more moveable portions that can move relative to each other to allow the seals 242 and/or slips 244 to be set through axial or rotational motion between the portions of the central mandrel 240.

The one or more seal elements 242 can comprise deformable elements that can be expanded into contact with an interior surface of the production tubing 120 to form a seal between the production tubing conversion device 202 and the interior of the production tubing 120. The seals can comprise elastomeric elements such as those used with packers. The slips can 244 generally comprise teeth or other features that can engage an interior surface of the production tubing 120. The teeth can penetrate (e.g., dig into) a short distance into the production tubing to thereby form a mechanical coupling between the production tubing conversion device 202 and the production tubing 120. The slips are generally designed to prevent relative axial and/or rotation motion between the production tubing 120 and the production tubing conversion device 202. In some embodiments, the production tubing conversion device 202 can be reversibly set within the production tubing such that the production tubing conversion device 202 can be mechanically and sealingly coupled within the production tubing 202 to perform a task or procedure and then decoupled from production tubing 120 and removed from the wellbore.

The one or more seal elements 242 can prevent fluid from channeling around the production tubing conversion device 202. As shown in FIG. 2, a flowpath can be formed through the production tubing conversion device 202 (e.g., as shown by the arrows in FIG. 2). Thus, the fluid can enter one or more inlets above the one or more seals 242 and pass through an interior channel in the production tubing conversion device 202 before passing out of the production tubing conversion device 202 below the one or more seals 242. While illustrated as passing through an interior of the central mandrel 240, the flowpath can pass through various flowpaths or even an exterior of the production tubing conversion device 202 in some configurations. Controlling the flow path may be useful in some instances to allow the fluid to be used to actuate various tools within a bottom hole assembly.

As also shown in FIG. 2, a lower end of the production tubing conversion device 202 can comprise a connection for coupling a bottom hole assembly to the production tubing conversion device 202. For example, a threaded connection can be used to threadedly couple a bottom hole assembly to the production tubing conversion device 202. The connection may allow a continuous fluid flowpath between the central mandrel of the production tubing conversion device and an interior flowpath through a bottom hole assembly. This configuration may allow various devices such as hydraulic motors, setting devices, and the like to be used to actuate the bottom hole assemblies.

The use of the connection on the production tubing conversion device 202 can allow a variety of bottom hole assemblies to be used with the systems and methods described herein. The bottom hole assemblies can be coupled to the production tubing conversion device 202 prior to insertion of the production tubing conversion device 202 into the production tubing 120. As a result, the diameter of the component or components used to form the bottom hole assembly can be less than the interior diameter of the production tubing to allow the bottom hole assembly to pass through the production tubing to the location at which the production tubing conversion device 202 is set within the production tubing 120. Any suitable thru-tubing tools (e.g., highly expandable tools) that use coiled tubing or wireline can be used. These devices can expand once passed through the production tubing and function in the larger diameter bore hole (e.g., in the casing, in an open hole, etc.) below the production tubing.

Figure 3A:
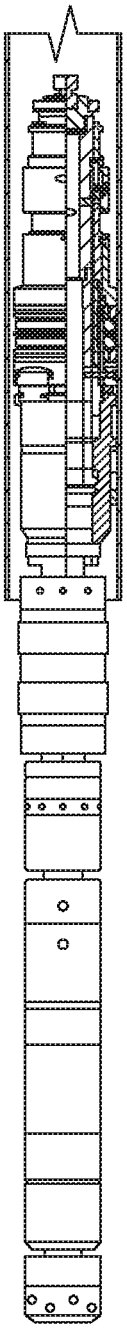
FIGS. 3A-3F illustrate schematic partial cross-sectional views of embodiments of a variety of bottom hole assemblies that can be used with a production tubing conversion device installed in a production tubing section.

FIGS. 3A-3F illustrate a variety of bottom hole assembly devices that can be used. For example, FIG. 3A illustrates an injection assembly comprising a plurality of seal elements. In some instances, the bottom hole assembly illustrated in FIG. 3A can comprise a jetting assembly. As described in more detail herein, the seal elements can be expanded into contact with an interior surface of a wellbore and/or casing section to allow a zone between the seal elements to be isolated. A wash fluid can then be injected into the zone to treat the zone of interest. A lower end of the bottom hole assembly illustrated in FIG. 3A can be used to wash the zone prior and/or after a procedure.

Figure 3B:
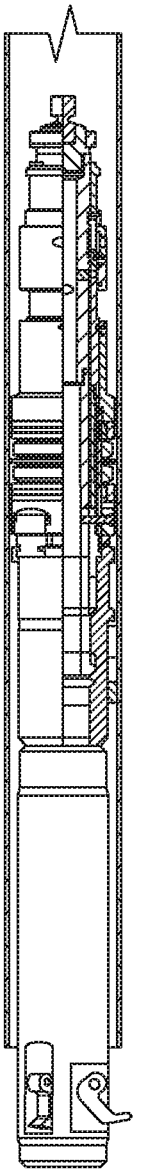
Figure 3C:
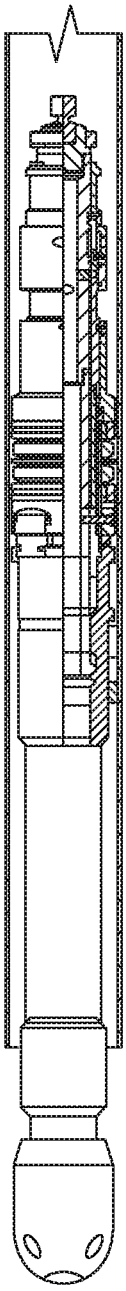
Figure 3D:
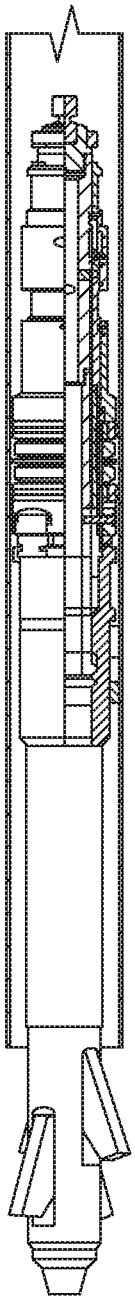
Figure 3E:
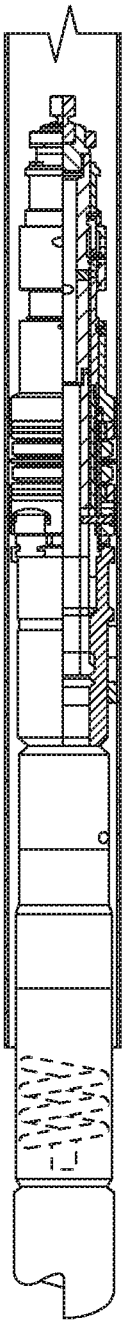
Figure 3F:
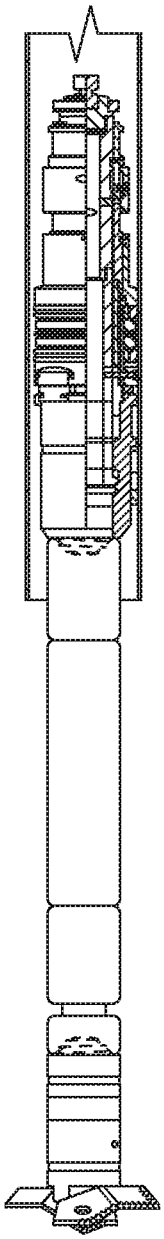

FIG. 3B illustrates a tubing or casing cutting tool. The cutting elements can be recessed within the tool and expanded into contact with a surface during use. A rotation of the tool can then be used cut a tubing or casing at a desired location. FIG. 3C illustrates a wash sub having a plurality of nozzles located at an angle along the lower portion of the sub. A pressurized fluid (e.g., passing through the production tubing conversion device 202) can be used to wash or abrade (e.g., when an abrasive fluid is used) a wellbore wall, tubing, or casing. FIG. 3D illustrates an underreamer assembly. In this assembly, the underreaming teeth or blades can be retained in recesses in the tool and extended in response to an activiation signal (e.g., a pressuraization of a fluid). When extended, the underreamer can be used to ream a tubing such as a tubing, casing, or other tool from a lower side. The underreamer can also or alternatively be used to ream cement, and/or a formation material from an area that has been milled to clean or provide a rock interface face. FIG. 3E illustrates a fishing tool which can be used to couple to a variety of devices within the wellbore. A removal of the production tubing may then allow the device coupled to the fishing tool to be removed from the wellbore. In some embodiments, the fishing tool can be retrieved through the production tubing to allow a retrieval of the device through the production tubing. FIG. 3F illustrates a section milling tool coupled to a motor (e.g., a hydraulic motor, etc.). As described in more detail herein, the section milling tool can comprise milling blades useful in milling or removing a portion of a casing, tubing, or other device installed within the wellbore.

Figure 4A:
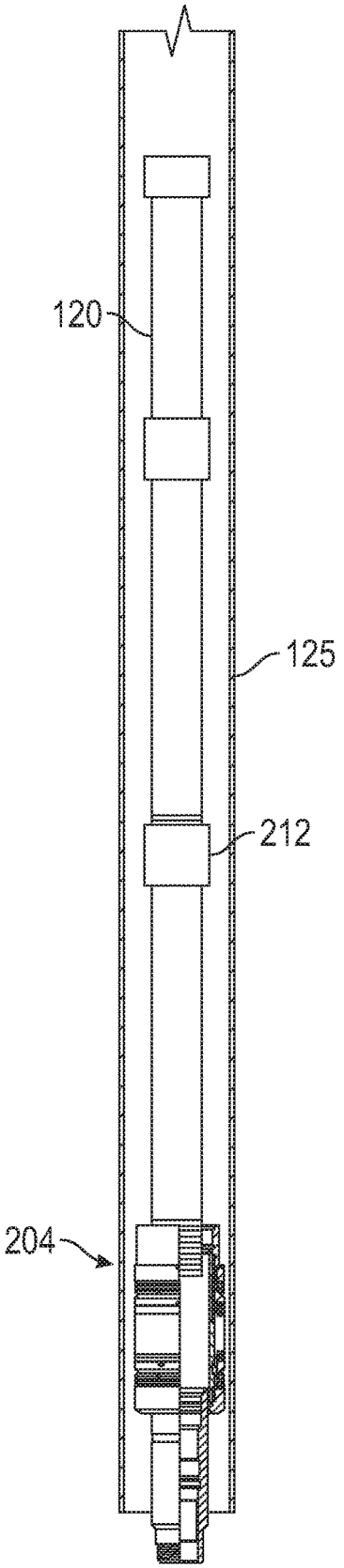
FIGS. 4A-4B illustrate schematic partial cross-sectional views of embodiments of a production tubing coupled to a lower completion assembly in an exemplary wellbore.

In use, the production tubing conversion device 202 can be installed in a production tubing within a wellbore. FIG. 4A illustrates an embodiment of a completion assembly with which the production tubing conversion device 202 can be used. As shown, the completion assembly can comprise a zonal isolation device 204 used to isolate a production zone below the zonal isolation device 204. In some embodiments, the zonal isolation device 204 can comprise a packer, a bridge plug, a valve, a production sleeve, or the like, and can be set within a casing 125 and/or against a formation wall. The production tubing 120 can be coupled to the zonal isolation device 204 to provide a production pathway for fluids from the production zone below the zonal isolation device 204 and the surface of the wellbore. As shown, the production tubing can comprise one or more joints 202 used to couple (e.g., threadedly connect, etc.) adjacent sections of the production tubing 120. Thus, FIG. 4A represents an embodiment of a production assembly in place within a wellbore.

In order to perform a workover on the wellbore, the production tubing 120 can be cut or separated at a cut point 210 to form an upper production tubing section 220 and a lower production tubing section 222. In some embodiments, the production tubing can be otherwise separated to form at least an upper production tubing section 220. For example, the production tubing can be decoupled from the zonal isolation device 204 to form the upper production tubing section. In an embodiment, a wireline or coiled tubing based cutter can be used to cut the production tubing from within the production tubing. While illustrated as forming a single cut in the production tubing, a plurality of cut points can be used to effectively produce a plurality of short production tubing sections. The shorter sections may fall within the space to the bottom or the wellbore or into a lower assembly such as the zonal isolation device 204.

Once the upper production tubing section is separated from a lower production tubing section or a lower completion assembly, the upper production tubing section can be raised upwards in the wellbore as needed to provide an interval over which a produced is to be performed. This interval can be adjusted during the workover procedures as needed. While the production tubing can be moved within the wellbore, it should be noted that the workover procedure can be performed without removing substantially all (or even a substantial portion of) the production tubing string.

Once the production tubing has been separated, a variety of procedures can be optionally performed as described in more detail herein. For example, various logging procedures, circulation procedures, perforating procedures, and the like can be performed using tools passing through the production tubing.

Figure 5A:
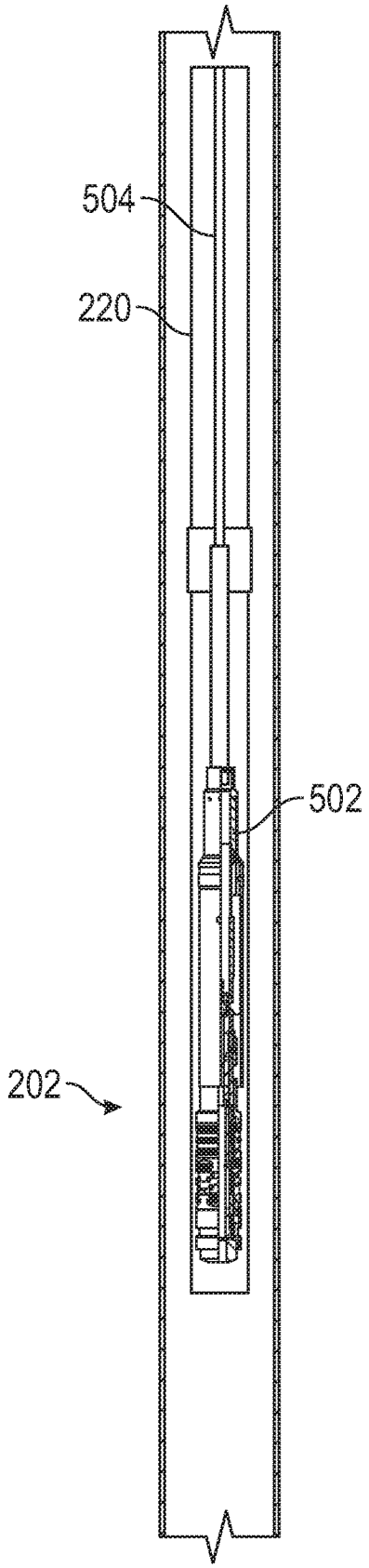
FIGS. 5A-5B illustrate schematic partial cross-sectional view of embodiments of a production tubing conversion device installation in a production tubing section.
Figure 5B:
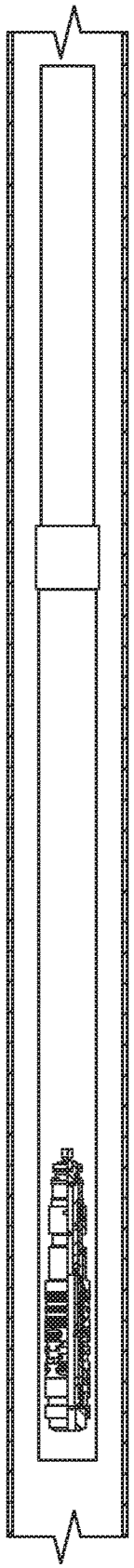

Referring to FIG. 5A, the production tubing conversion device 202 can be installed in the upper production tubing section 220 using a setting tool 502 that can be conveyed on a wireline or coiled tubing 504. As shown, the production tubing conversion device 202 can be conveyed to the desired position within the upper production tubing section 220. While a bottom hole assembly is not shown in FIG. 5A, any suitable bottom hole assembly can be coupled to the production tubing conversion device 202 as the production tubing conversion device 202 is positioned within the upper production tubing section 220. For example, any of the bottom hole assemblies described with respect to FIGS. 3A-3F can be coupled to the production tubing conversion device 202 as it is positioned within the upper production tubing section 220. Once the production tubing conversion device 202 is disposed in position at the desired location in the upper production tubing section 220, an actuation signal or force can be applied to the production tubing conversion device 202 to set the one or more seals and the slips and mechanically couple the production tubing conversion device 202 to the upper production tubing section 220. At this point, the conveyance 504 and setting tool 502 can be released from the production tubing conversion device 202 and retrieved from the wellbore. The production tubing can then appear as shown in FIG. 5B with the production tubing conversion device 202 set within the upper production tubing section 220. While not illustrated in FIG. 5B, a bottom hole assembly can also be coupled to a lower end of the production tubing conversion device 202 to allow one or more workover procedures to be performed.

Once the workover procedures are complete, the production tubing conversion device 202 can be retrieved from the upper production tubing section 220 along with any bottom hole assembly coupled thereto. In some embodiments, such as when an abandonment procedure is performed, the production tubing completion assembly 202 can be left within the upper production tubing section 220 along with any bottom hole assembly. If another completion is being performed, the production tubing can be cut or separated above the production tubing conversion device 202 and raised. The process can then be repeated as needed.

The production tubing conversion device can be used with a variety of workover procedures to allow the production tubing to be used as a workover string during the procedures. In an embodiment, the production tubing conversion device 202 can be used to perform an abandonment procedure. This type of procedure is typically carried out at the end of the useful life of a wellbore, at which time costs are generally be minimized. In some embodiments, only a portion of a wellbore may be abandoned, and another completion above the abandoned completion zone can be prepared. Such procedures can be used when water levels within a wellbore reach unacceptable levels. In this instance, a lower production zone can be filled or capped with a sealant and the well can be recompleted higher in the formation to avoid excess water production.

Further, the various elements of the wellbore may need to be disposed during the abandonment procedure. This can include production tubing that is removed from the wellbore. In some instances, if insufficient funds are available to abandon the wellbore, no abandonment procedure may be carried out, or an insufficient abandonment procedure that does not verify the integrity of the casing and cement bond behind the case may be used. The production tubing conversion device as described here can be used to convert the production tubing into a workover string for an abandonment procedure. This may reduce the overall abandonment procedure costs by avoiding the need for the heavy lifting rig while also allowing the production tubing to remain in the wellbore to be disposed of as part of the abandonment procedure.

During an abandonment procedure, whether of the entire wellbore or one or more zones, most regulations require that a certain length of proper cement bonding exist between the casing and the formation. If the required bonding length is not present, a workover procedure to provide the minimum bonding length can be performed as part of the abandonment procedure, thereby providing a properly bonded casing as well as a cement plug within the casing (e.g., within the annulus, the production tubing, and the like) suitable to meet the abandonment regulations within each jurisdiction.

In general, an abandonment procedure comprises checking the cement bonding between the casing and the wellbore wall. If the cement bonding integrity is less than that needed to abandon the wellbore, one or more procedures can be implemented to allow access to the areas or zones in which the cement bonding is not adequate. Cement can then be placed between the casing and the wellbore wall as an individual procedure or as part of also filling the casing with a sealant plug. While the sealant used in abandonment procedures is generally cement, other types of sealants can also be used such as clays, polymers, concrete and the like. When a suitable seal is formed in the wellbore, the wellbore can be considered abandoned.

Figure 4B:
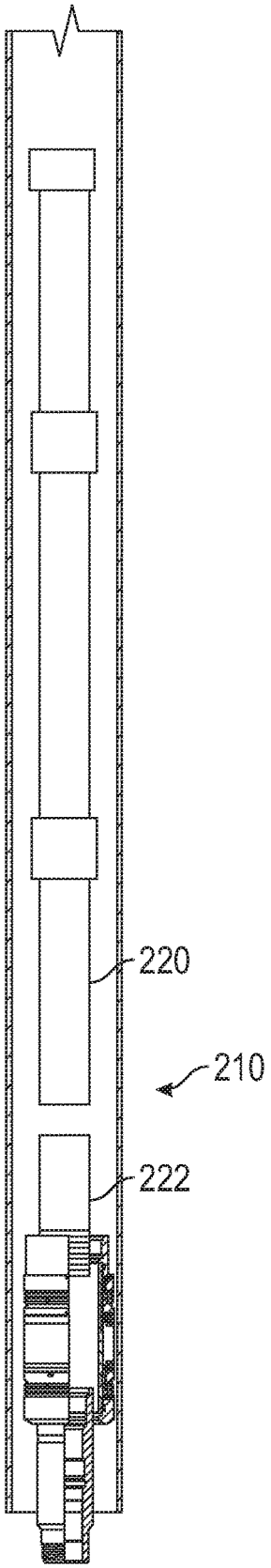

In an embodiment, a first abandonment procedure can use a reamer when a loss of cement bonding is detected between the casing and the wellbore wall. Typically, the wellbore may be in the configuration shown in FIG. 4A, where a production zone is isolated by a zonal isolation device 204 and the production tubing 120 provides a fluid pathway between the production zone and the surface of the wellbore. In order to perform the abandonment procedure, the production tubing can be cut or separated as described with respect to FIGS. 4A-4B to form at least an upper production tubing section 220.

When the production tubing 120 is cut, both an upper production tubing section 220 and a lower production tubing section 222 can be formed. Once the production tubing 120 is cut, the upper production tubing section can be raised away from the lower production tubing section and/or the lower completion assembly. The upper production tubing section 220 can generally be raised above an abandonment zone taking into account an additional working space for tools and the installation of the production tubing conversion device with the bottom hole assembly. The abandonment zone would include a section of the wellbore and/or casing having a sufficient axial length to form a plug meeting the regulations for abandoning a well or a section of a well. For example, if one thousand feet of sealant are needed, the upper production tubing section may be raised at least one thousand feet above the lower production tubing section and/or the production assembly to allow for the formation of the sealant plug to be formed. In some instances, the upper production tubing section 220 may be raised higher to provide additional working room for the logging and workover tools. In still other embodiments, the upper production tubing section may be at or below the abandonment zone interval.

Figure 6:
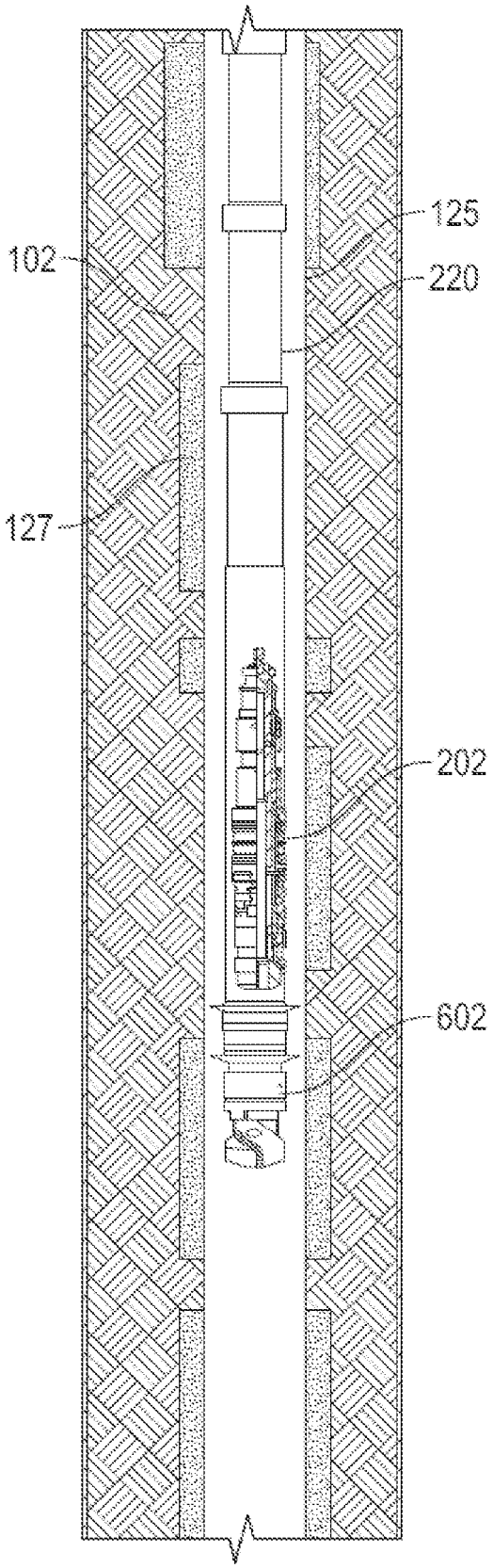
FIG. 6 illustrates a schematic partial cross-sectional view of an embodiment of a production tubing conversion device coupled to a bottom hole assembly installed in a production tubing section.

Once the upper production tubing section 220 is positioned above the abandonment zone, the casing within the abandonment zone can be logged to determine the cement bond quality within the abandonment zone. The logging tools can be passed through the upper production tubing section into the abandonment zone below the upper production tubing section. An exemplary casing section that can be logged is shown in FIG. 6. As shown, the casing 125 can be positioned within the formation 102, and cement 127 can be present in the annulus between the casing 125 and the wellbore wall formed by the formation 102. When the cement is placed in the annulus during the drilling and completion of the wellbore, the cement is intended to be present as a consistent layer that is bonded to both the casing and the formation without any voids or loss of bonding. However, the cement may have voids due to various reasons during the completion process and during production. In some embodiments, the poor cement bonding can also be due to a loss of bonding between the cement and the casing and/or the wellbore wall. The loss of bonding can result in cracks or channels that can create a pathway for potential fluid flow up the wellbore.

If the cement is bonded over the appropriate length, then no further action may be needed, and a production tubing conversion device having a sealant injection tool can be used to fill the casing with the sealant. However, if the required length of adequate cement bonding is not present, the logging can be used to identify a target section having the poor cement bonding between the casing and the wellbore wall. As shown in the exemplary embodiment of FIG. 6, a number of voids can be present between the cement. The logging of the wellbore in the abandonment zone can identify these voids and/or loss of bonding.

Once the abandonment zone is logged and a target zone is identified in which the cement quality is to be addressed, the production tubing conversion device can be installed within the upper production tubing section as described herein. In an embodiment, the production tubing conversion device 202 can be coupled to a section milling tool 602 that is coupled to and disposed below the production tubing conversion device 202. The upper production tubing section 220 can be positioned at a depth that allows the section milling tool to contact and mill a desired section of the casing before or after the production tubing conversion device 202 is installed with the section milling tool 602. In some embodiments, an optional cementing tool having an optional agitator can be included in the bottom hole assembly (e.g., in series with the section milling tool). The optional cementing tool can be used to cement after milling without removing the production tubing conversion device 202 from the upper production tubing section 220 to change the bottom hole assembly.

As shown in FIG. 6, the section milling tool 602 can have milling blades that can initially be folded or recessed within the tool body such that the section milling tool 602 has a diameter that is less than an interior diameter of the upper production tubing section. This can allow the section milling tool 602 to be passed through the interior of the upper production tubing section 220 with the production tubing conversion device 202. Once the production tubing conversion device 202 is properly positioned within the upper production tubing section 220, the section milling tool 602 may extend below a lower end of the upper production tubing section 220. The section milling tool 602 can then be opened so that the milling blades extend outwards into contact with the casing 125, as shown in FIG. 7A.

Figure 7A:
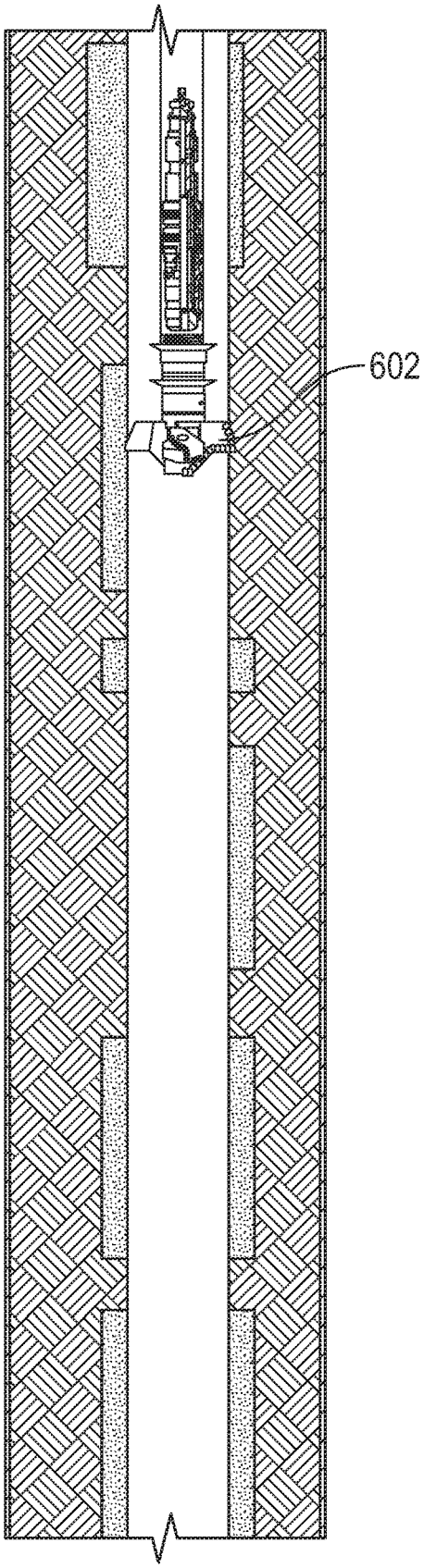
FIGS. 7A-7C illustrate schematic partial cross-sectional progressive views of an embodiment of an abandonment procedure using a production tubing conversion device coupled to a bottom hole assembly.
Figure 7B:
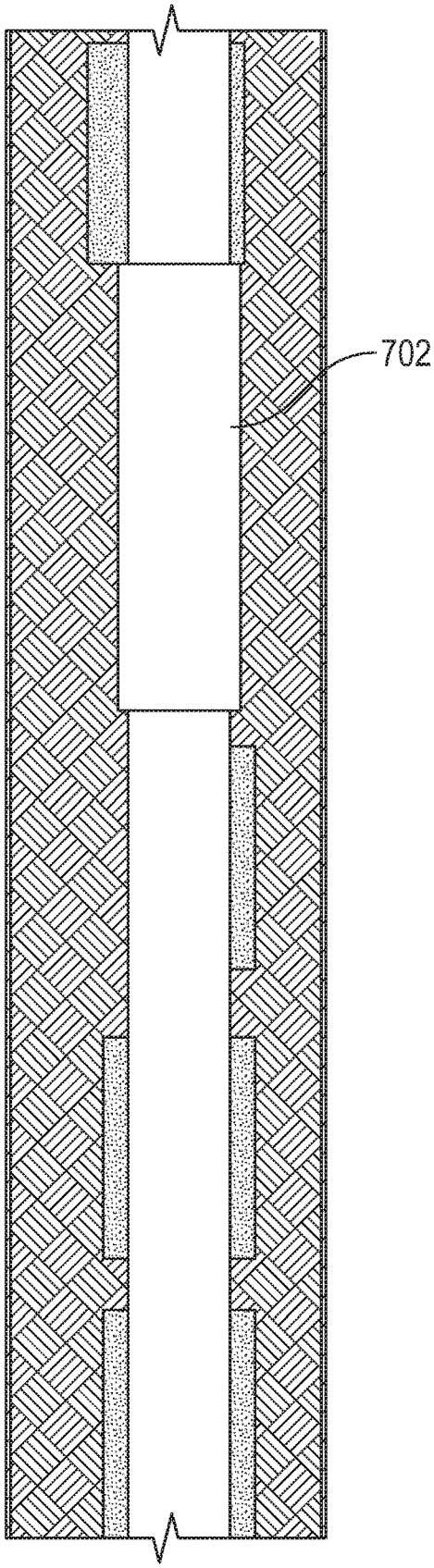

The section milling tool 602 can then be used to mill the casing and remove at least a portion of the casing and/or cement to produce a milled section 702 as shown in FIG. 7B. It can be noted that the production tubing conversion device 202 with the section milling tool 602 illustrated in FIG. 7A does not have a motor. In this instance, the milling process can rely on the mechanical coupling of the production tubing conversion device 202 to the upper production tubing section 220 to allow a rotation of the upper production tubing section 220 to cause a rotation in the section milling tool. In order to mill the casing, the upper production tubing section 220 can be rotated and lowered to allow the cutting blades or bits to contact the casing and remove the casing. The casing that is removed can fall downwards in the wellbore. The remaining structure is that of an open hole section 702 in the milled section as shown in FIG. 7B, where the casing is removed, potentially along with some amount of any original cement.

While illustrated in FIG. 7A as having the section milling tool 602 directly coupled to the production tubing conversion device 202, a motor assembly such as a hydraulic motor can also be used. Such an assembly would be similar to the assembly shown and described with respect to FIG. 3F. In this embodiment, the motor can convert a hydraulic pressure of a fluid into a rotation motion of the milling blades or bits. Thus, a fluid can be passed through the upper production tubing section 220, through the production tubing conversion device 202, and through the hydraulic motor to cause a rotation of the section milling tool. The fluid passing out of the hydraulic motor can be circulated to the surface for pumping and recycling down the production tubing. The rotating blades can then be contacted with the casing, for example by lowering the upper production tubing section while rotating the blades, to create the open hole section 702.

Once the open hole section 702 is created, a sealant such as cement can be injected into the wellbore through the upper production tubing section to create a plug within the wellbore having sufficient length to properly abandon the well or the desired production zone. In some embodiments, the production tubing conversion device 202 and the associated section milling tool 602 can be removed prior to injecting the sealant. The sealant can then be injected through the upper production tubing section directly or another assembly comprising a production tubing conversion device 202 coupled to a cement injection tool can be disposed in the upper production tubing section 220 first. In some embodiments, a cement injection tool can be used that serves to inject the cement and create vibrations during the injection process to reduce the occurrence of voids in the resulting plug.

In some embodiments, the sealant can be injected directly through the section milling tool (e.g., directly or through an optional cementing tool). In this embodiment, the production tubing conversion device 202 and the section milling tool 602 may be filled with cement at the end of the process and left in the wellbore. Some portion of the upper production tubing section 220 and/or an annulus between the casing and the upper production tubing section 220 can also be filled with the sealant. This may allow the production tubing to be abandoned in the wellbore rather than needing to remove and dispose of the production tubing.

Figure 7C:
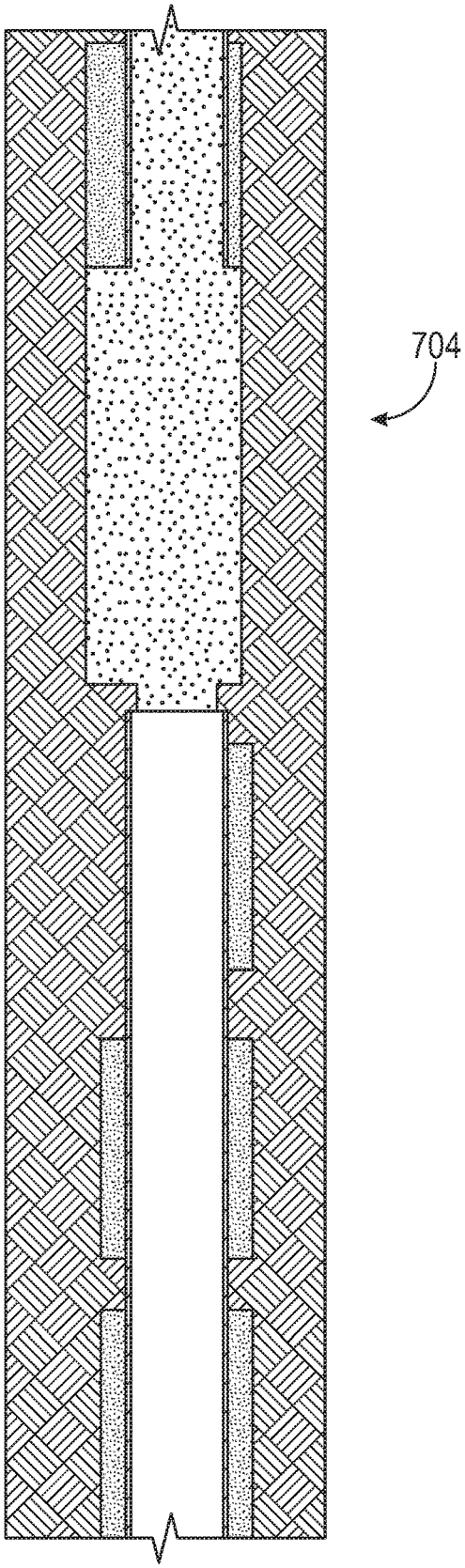

At the end of the injection process, a sealant plug 704 as shown in FIG. 7C can be formed within the wellbore. The sealant plug can be formed in the casing section that has been milled away as well as potentially a portion of the wellbore above and/or below the casing section. This can include filling a portion of the production tubing.

In an embodiment, an abandonment procedure can be carried out by perforating the casing in an area identified as having poor cement bonding quality followed by cementing through the perforations. An optional acid wash can be used to clean out the existing cement and the formation wall to prepare the surfaces for receiving and bonding to new cement.

The abandonment procedure may begin in the same way as described above with respect to the milling process, and similar steps are not discussed in detail in the interest of brevity. Briefly, the production tubing that is coupled to a lower completion assembly can be cut or separated to form at least an upper production tubing section. The upper production tubing section can be raised away from the lower completion assembly to allow for optional logging of the abandonment zone, which can be used to identify a target section having poor cement bonding between a cement layer and the casing and/or formation wall.

Once the target zone is identified, the casing in the target section can be perforated. Any suitable perforation tool can be used and can be passed through the upper production tubing into the target zone. In general, a perforation tool comprises a sealed housing containing a plurality of shaped charges that are coupled to a detonator. The perforation tool can be conveyed on a wireline tool, which can also provide the ignition signal to a detonator within the housing. Upon detonation, the shaped charges can form a plurality of holes or perforations through the housing, the casing, the cement, and potentially into the formation. The resulting holes or perforations can then provide fluid communication between the interior of the casing and the annulus between the casing and the formation. After perforating the casing in the target zone, the perforation gun can be retrieved from the wellbore.

Figure 8A:
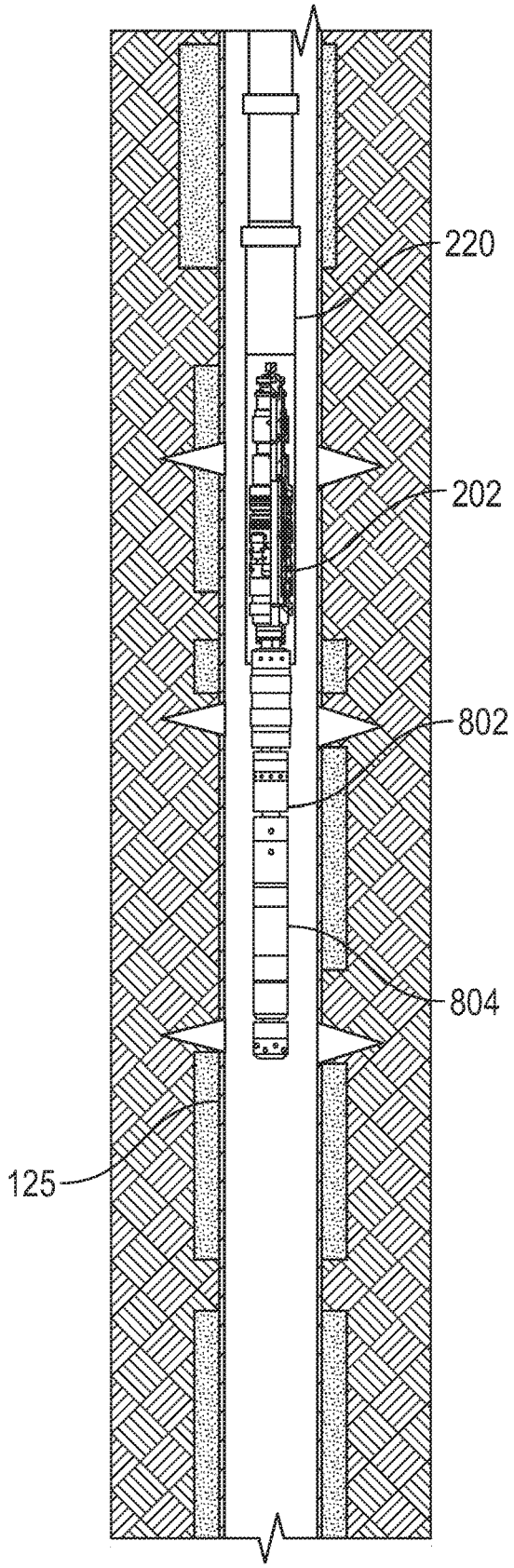
FIGS. 8A-8D illustrate schematic partial cross-sectional progressive views of another embodiment of an abandonment procedure using a production tubing conversion device coupled to one or more bottom hole assemblies.
Figure 8B:
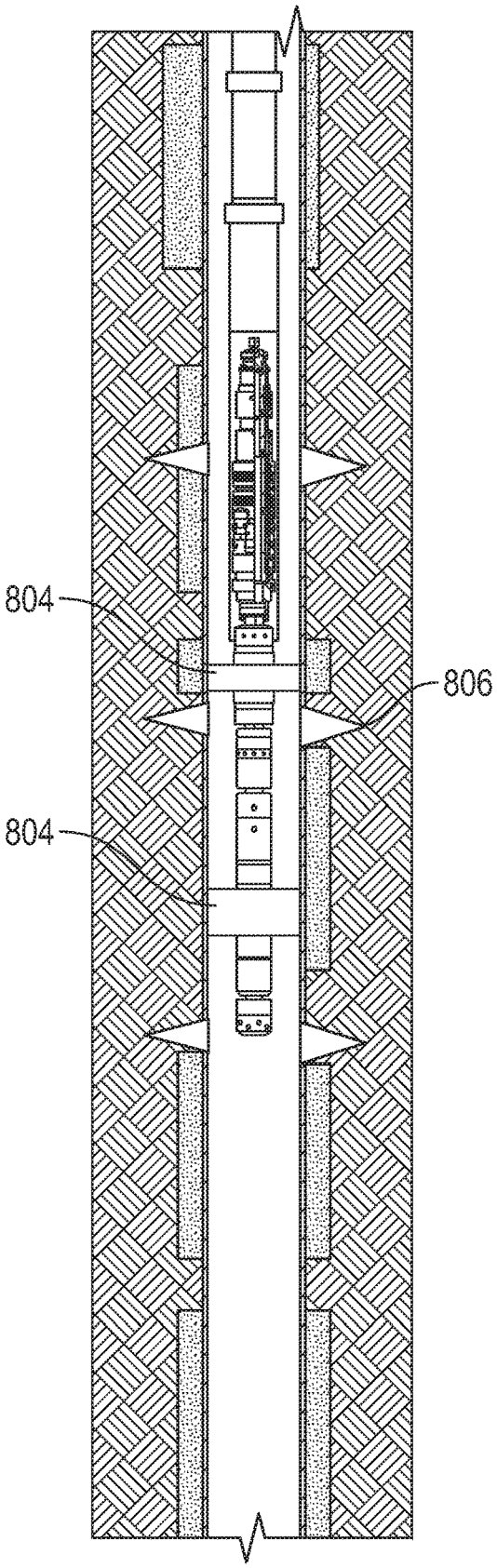

As shown in FIG. 8A, the production tubing conversion device 202 can be installed in the upper production tubing section 220 once the perforations are formed. An injection assembly 802 can be coupled to the production tubing conversion device 202 and disposed to extend below the end of the upper production tubing section 220. As described with respect to FIG. 3A, the injection assembly 802 can comprise a plurality of seal elements 804, and optionally one or more jetting assemblies, wash assemblies, and the like. The seal elements 804 can be expandable or inflatable to contact an interior surface of the casing 125. For example, the seal elements 804 can be expanded based on a fluid pressure supplied through the upper production tubing section and through the production tubing conversion device. Other activation mechanisms can be based on flow rate, mechanical manipulation, or any other suitable force on the injection assembly 802.

The seal elements 804 can be spaced apart such that when the seal elements are expanded into contact with the interior of the casing, a zone between the seal elements 804 can be isolated. The seal elements can be used to isolate one or more perforations through the casing such as perforations 806. A stimulation or injection fluid can then be passed into the isolated zone to prepare the casing for remedial treatment. For example, an acid wash can be used to remove at least a portion of the existing cement between the casing 125 and the formation to provide room for new sealant to be injected. The injected fluid can be supplied under pressure to pass through the perforations. In some embodiments, a jetting assembly can be used to pass the fluid under pressure to the perforations in addition to be supplied as a jet into the sealed zone between the seal elements 804.

Figure 8C:
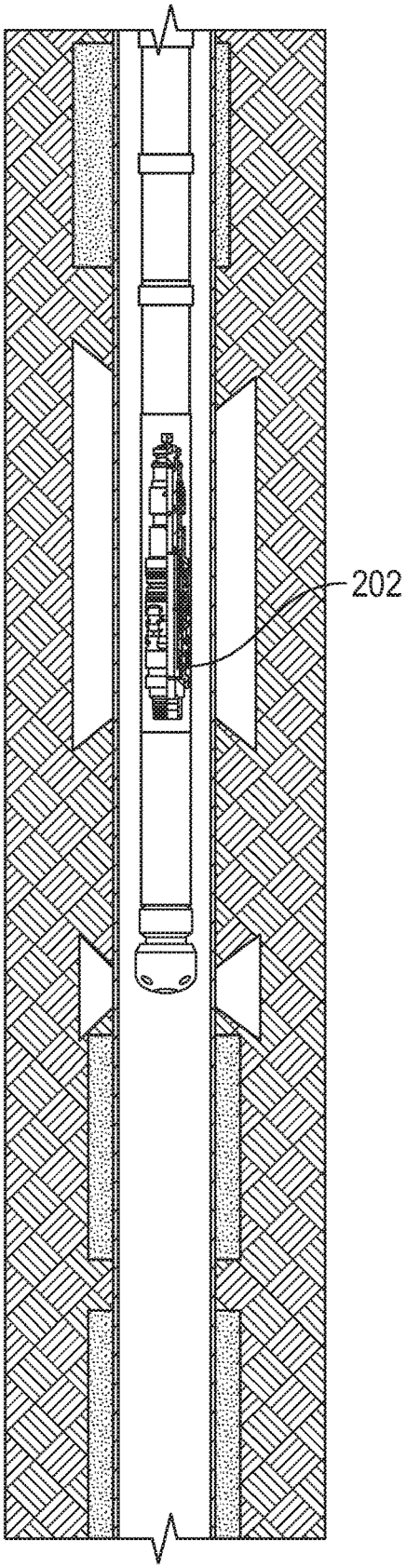

As shown in FIG. 8C, the resulting treatment can treat the existing cement layer and a portion of the formation to provide a pocket or cavity for receiving new sealant. In some embodiments, the injection assembly can be reset and moved to a different interval and the treatment procedure repeated. This can include moving the upper production tubing section 220 so as to position the injection assembly at the desired interval.

Once all of the desired treatment intervals are treated, a sealant can be injected into the wellbore through the upper production tubing section 220 and through the production tubing conversion device 202. The sealant (such as cement, clays, or the like) is injected into the casing, it can pass through the perforations and fill the annulus between the casing 125 and the formation, thus creating the desired bonding between the casing and the formation.

In some embodiments, the sealant can be used with the injection assembly in place. In other embodiments, a different bottom hole assembly can be used. In order to change the bottom hole assemblies, the production tubing conversion device 202 can be retrieved through the upper production tubing section and then repositioned with a new bottom hole assembly. In an embodiment, a cement injection tool can be used during the sealant injection process. The cement injection tool can include one or more ports for cement to pass from the upper production tubing section 220 into the casing section while optionally creating vibrations, jetting, or other fluid motion to properly distribute the sealant. The sealant can be supplied under pressure so that the sealant fills the casing and passes through the perforations into the cavities formed during the treatment process.

Figure 8D:
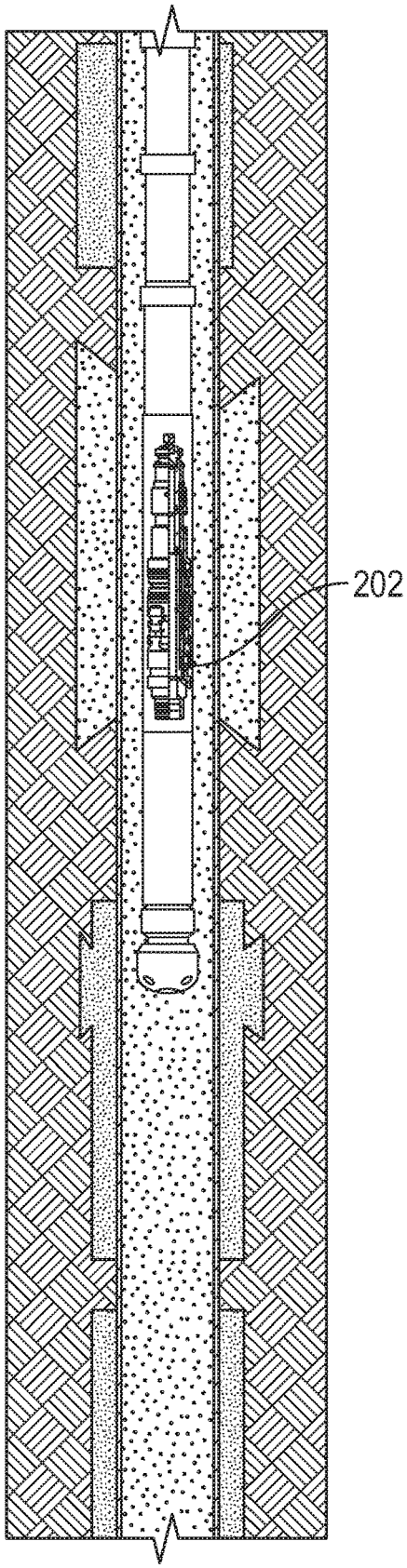

The resulting configuration can be as shown in FIG. 8D where the casing, and the cavities are filled with the sealant to form a plug in the wellbore suitable to allow the wellbore and/or the desired zone to be abandoned. As shown in FIG. 8D, the production tubing, the production tubing conversion device 202, and the sealant injection tool can all be filled with the sealant and left within the wellbore. This may be useful when the production tubing is to be abandoned within the wellbore. In other embodiments, the production tubing, the production tubing conversion device 202, and/or the injection tool can be removed from the wellbore after injection of the sealant.

While generally discussed herein as being used to abandon a wellbore, the abandonment processes described herein can also be used to abandon a zone within a wellbore. For example, a lower production zone can be abandoned in favor of a recompletion higher in the wellbore to avoid excessive water production (e.g., a high water cut). The recompletion process can generally begin with the abandonment processes as described herein. After the completion of the abandonment processes, the production tubing can be cut or separated above a point that is filled with sealant, or the production tubing can be raised above the sealant if not left to be encased within the sealant. The recompletion can then proceed using the production tubing conversion device. For example, the tubing can be cut above the abandoned zone, the resulting upper production tubing section can be raised at or above a desired recompletion location, and a production tubing conversion device can be installed with a new completion assembly. The completion assembly can include any number of desired components such as a completion packer and production assembly below the completion packer. The well can then continue to be produced through the new completion assembly using the same production tubing previously in the wellbore. Thus, the recompletion process can be performed without removing the production tubing from the wellbore. In some embodiments, this can include abandoning the production tubing in the abandonment zone in the wellbore. This can result in remove none of or very little of the existing production tubing during the recompletion process.

While described in various embodiments as being used for performing abandonment procedures, the use of the existing production tubing as a work string through the deployment of the production tubing conversion device can allow a number of workover procedures to be performed using the existing production tubing. Such procedures may be useful in avoiding the need for heavy lifting rigs as well as reducing the overall time to remove and replace the production tubing with a work string in most workover procedures.

Having described various devices and methods, certain aspects or embodiments can include, but are not limited to:

In a first aspect, a method comprises cutting a production tubing disposed in a wellbore to form a lower production tubing section and an upper production tubing section; displacing the upper production tubing section away from the lower production tubing section; installing a production tubing conversion device within the upper production tubing section, wherein the production tubing conversion device is coupled to a bottom hole assembly disposed below the production tubing conversion device; and injecting a sealant into the wellbore through the upper production tubing section, through the production tubing conversion device, and through the bottom hole assembly.

A second aspect can include the method of the first aspect, wherein cutting the production tubing uses a wireline or coiled tubing cutting tool.

A third aspect can include the method of the first or second aspect, further comprising: logging the wellbore between the upper production tubing section and the lower production tubing section after displacing the upper production tubing section and before installing the production tubing conversion device.

A fourth aspect can include the method of any of the first to third aspects, wherein installing the production tubing conversion device within the upper production tubing section comprises: placing the production tubing conversion device at the desired location in the upper production tubing section; setting seals against an interior surface of the upper production tubing section; engaging slips with the interior surface of the upper production tubing section; and establishing a flowpath from an interior of the upper production tubing section through at least a portion of the production tubing conversion device.

A fifth aspect can include the method of any of the first to fourth aspects, wherein the slips are configured to mechanically couple the production tubing conversion device with the upper production tubing section.

A sixth aspect can include the method of the fourth or fifth aspect, wherein the seals are configured to prevent flow of a fluid between the production tubing conversion device and the interior surface of the upper production tubing section.

A seventh aspect can include the method of any of the first to sixth aspects, further comprising: removing the production tubing conversion device and the bottom hole assembly from the wellbore.

An eighth aspect can include the method of the seventh aspect, wherein removing the production tubing conversion device and the bottom hole assembly from the wellbore is performed with a wireline or coiled tubing retrieval tool.

In a ninth aspect, a method comprises: cutting a production tubing disposed in a wellbore to form a lower production tubing section and an upper production tubing section; displacing the upper production tubing section away from the lower production tubing section; installing a production tubing conversion device within the upper production tubing section, wherein the production tubing conversion device is coupled to a section milling tool disposed below the production tubing conversion device; milling away a casing section using the section milling tool; and injecting a sealant into the wellbore through the upper production tubing section and through the production tubing conversion device.

A tenth aspect can include the method of the ninth aspect, further comprising: logging a cement quality behind a casing prior to installing the production tubing conversion device; and identifying a target section.

An eleventh aspect can include the method of the ninth or tenth aspect, further comprising: positioning the upper production tubing section at a depth configured to allow the section milling tool to contact the casing section.

A twelfth aspect can include the method of any of the ninth to eleventh aspects, wherein the section milling tool comprises a hydraulic motor, and wherein milling away the casing section comprises: passing a fluid through the hydraulic motor; rotating the section milling tool in response to the fluid passing through the hydraulic motor; and contacting the casing section with the rotating section milling tool.

A twelfth aspect can include the method of any of the ninth to thirteenth aspects, wherein the production tubing conversion device is mechanically coupled to the upper production tubing section, and wherein milling away the casing section comprises: rotating the upper production tubing section; rotating the section milling tool in response to the rotation of the upper production tubing section; and contacting the casing section with the rotating section milling tool.

A fourteenth aspect can include the method of any of the ninth to thirteenth aspects, further comprising: opening the section milling tool after installing the production tubing conversion device and the section milling tool, wherein the section milling tool is configured to have a diameter less than an interior diameter of the upper production tubing section while being installed through the upper production tubing section.

A fifteenth aspect can include the method of any of the ninth to fourteenth aspects, wherein injecting the sealant into the wellbore occurs while the production tubing conversion device and the section milling tool remain installed in the upper production tubing section.

In a sixteenth aspect, a method comprises: cutting a production tubing disposed in a wellbore to form a lower production tubing section and an upper production tubing section; displacing the upper production tubing section away from the lower production tubing section; perforating a casing section below the upper production tubing section to form perforations in the casing section; installing a production tubing conversion device within the upper production tubing section, wherein the production tubing conversion device is coupled to a bottom hole assembly disposed below the production tubing conversion device; and injecting a sealant into the wellbore through the upper production tubing section and through the production tubing conversion device, wherein the sealant passes through the perforations in the casing section.

A seventeenth aspect can include the method of the sixteenth aspect, further comprising: logging the wellbore below the upper production tubing section; and identifying a target section, wherein the perforation of the casing section is in the target section.

An eighteenth aspect can include the method of the sixteenth or seventeenth aspects, wherein the bottom hole assembly comprises a zonal isolation device configured to isolate the casing section after the perforating, and wherein the method further comprises: isolating the casing section after the perforating; injecting a stimulation fluid into the casing section while it is isolated; and treating a formation layer behind the casing section, wherein the formation layer is at least partially filled with the sealant in response to the injecting of the sealant.

A nineteenth aspect can include the method of the eighteenth aspect, wherein injecting the stimulation fluid comprises injecting an acid wash into the casing section, and wherein the acid wash passes through the perforations during the injection of the acid wash.

A twentieth aspect can include the method of any of the sixteenth to nineteenth aspects, wherein the bottom hole assembly comprises a cement injection tool, and wherein injecting the sealant into the wellbore comprises injecting cement through the cement injection tool into the wellbore.

In a twenty first aspect, a method comprises: installing a production tubing conversion device within a production tubing section disposed in a wellbore, wherein the production tubing conversion device is coupled to a bottom hole assembly disposed below the production tubing conversion device, wherein the production tubing conversion device comprises: a central mandrel, one or more seals disposed between the central mandrel and an interior surface of the production tubing section, and one or more slips engaging the interior surface of the production tubing section, wherein the one or more slips are configured to mechanically couple the central mandrel to the production tubing section; and performing a workover procedure in the bottom assembly coupled to the production tubing conversion device.

In a twenty second aspect, a workover system comprises: a production tubing section disposed in a wellbore; a production tubing conversion device disposed within the production tubing section at or near an end of the production tubing section, wherein the production tubing conversion device comprises: a central mandrel, one or more seals disposed between the central mandrel and an interior surface of the production tubing section, and one or more slips engaging the interior surface of the production tubing section, wherein the one or more slips are configured to mechanically couple the central mandrel to the production tubing section; and a bottom hole assembly coupled to the production tubing conversion device, wherein the bottom hole assembly is mechanically and fluidly coupled to the production tubing section through the production tubing conversion device.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method comprising:

cutting a production tubing disposed in a wellbore to form a lower production tubing section and an upper production tubing section;

displacing the upper production tubing section away from the lower production tubing section;

installing a production tubing conversion device within the upper production tubing section, wherein the production tubing conversion device is coupled to a bottom hole assembly disposed below the production tubing conversion device; and injecting a sealant into the wellbore through the upper production tubing section, through the production tubing conversion device, and through the bottom hole assembly.

2. The method of claim 1, wherein cutting the production tubing uses a wireline or coiled tubing cutting tool.

3. The method of claim 1, further comprising: logging the wellbore between the upper production tubing section and the lower production tubing section after displacing the upper production tubing section and before installing the production tubing conversion device.

4. The method of claim 1, wherein installing the production tubing conversion device within the upper production tubing section comprises:

placing the production tubing conversion device at the desired location in the upper production tubing section;

setting seals of the production tubing conversion device against an interior surface of the upper production tubing section;

engaging slips of the production tubing conversion device with the interior surface of the upper production tubing section; and establishing a flowpath from an interior of the upper production tubing section through at least a portion of the production tubing conversion device.

5. The method of claim 4, wherein the slips are configured to mechanically couple the production tubing conversion device with the upper production tubing section.

6. The method of claim 4, wherein the seals are configured to prevent flow of a fluid between the production tubing conversion device and the interior surface of the upper production tubing section.

7. The method of claim 1, further comprising:

removing the production tubing conversion device and the bottom hole assembly from the wellbore.

8. The method of claim 7, wherein removing the production tubing conversion device and the bottom hole assembly from the wellbore is performed with a wireline or coiled tubing retrieval tool.

9. A method comprising:

cutting a production tubing disposed in a wellbore to form a lower production tubing section and an upper production tubing section;

displacing the upper production tubing section away from the lower production tubing section;

installing a production tubing conversion device within the upper production tubing section, wherein the production tubing conversion device is coupled to a section milling tool disposed below the production tubing conversion device;

milling away a casing section using the section milling tool; and injecting a sealant into the wellbore through the upper production tubing section and through the production tubing conversion device.

10. The method of claim 9, further comprising:

logging a cement quality behind a casing prior to installing the production tubing conversion device; and identifying a target section.

11. The method of claim 9, further comprising:

positioning the upper production tubing section at a depth configured to allow the section milling tool to contact the casing section.

12. The method of claim 9, wherein the section milling tool comprises a hydraulic motor, and wherein milling away the casing section comprises:

passing a fluid through the hydraulic motor;

rotating the section milling tool in response to the fluid passing through the hydraulic motor; and contacting the casing section with the rotating section milling tool.

13. The method of claim 9, wherein the production tubing conversion device is mechanically coupled to the upper production tubing section, and wherein milling away the casing section comprises:

rotating the upper production tubing section;

rotating the section milling tool in response to the rotation of the upper production tubing section; and contacting the casing section with the rotating section milling tool.

14. The method of claim 9, further comprising:

opening the section milling tool after installing the production tubing conversion device and the section milling tool, wherein the section milling tool is configured to have a diameter less than an interior diameter of the upper production tubing section while being installed through the upper production tubing section.

15. The method of claim 9, wherein injecting the sealant into the wellbore occurs while the production tubing conversion device and the section milling tool remain installed in the upper production tubing section.

16. A method comprising:

cutting a production tubing disposed in a wellbore to form a lower production tubing section and an upper production tubing section;

displacing the upper production tubing section away from the lower production tubing section;

perforating a casing section below the upper production tubing section to form perforations in the casing section;

installing a production tubing conversion device within the upper production tubing section, wherein the production tubing conversion device is coupled to a bottom hole assembly disposed below the production tubing conversion device; and injecting a sealant into the wellbore through the upper production tubing section and through the production tubing conversion device, wherein the sealant passes through the perforations in the casing section.

17. The method of claim 16, further comprising:

logging the wellbore below the upper production tubing section; and identifying a target section, wherein the perforation of the casing section is in the target section.

18. The method of claim 16, wherein the bottom hole assembly comprises a zonal isolation device configured to isolate the casing section after the perforating, and wherein the method further comprises:

isolating the casing section after the perforating;

injecting a stimulation fluid into the casing section while it is isolated; and treating a formation layer behind the casing section, wherein the formation layer is at least partially filled with the sealant in response to the injecting of the sealant.

19. The method of claim 18, wherein injecting the stimulation fluid comprises injecting an acid wash into the casing section, and wherein the acid wash passes through the perforations during the injection of the acid wash.

20. The method of claim 16, wherein the bottom hole assembly comprises a cement injection tool, and wherein injecting the sealant into the wellbore comprises injecting cement through the cement injection tool into the wellbore.

21. A method comprising:

installing a production tubing conversion device within a production tubing section disposed in a wellbore, wherein the production tubing conversion device is coupled to a bottom hole assembly disposed below the production tubing conversion device, wherein the production tubing conversion device is positioned in the production tubing section and the bottom hole assembly is hung from the production tubing conversion device below a downhole end of the production tubing section, wherein the production tubing conversion device comprises:

a central mandrel, one or more seals disposed between the central mandrel and an interior surface of the production tubing section, and one or more slips engaging the interior surface of the production tubing section, wherein the one or more slips are configured to mechanically couple the central mandrel to the production tubing section; and performing a workover procedure in the bottom assembly coupled to the production tubing conversion device.

22. A workover system comprising:

a production tubing section disposed in a wellbore;

a production tubing conversion device disposed within the production tubing section at or near a downhole end of the production tubing section, wherein the production tubing conversion device comprises:

a central mandrel, one or more seals disposed between the central mandrel and an interior surface of the production tubing section, and one or more slips engaging the interior surface of the production tubing section, wherein the one or more slips are configured to mechanically couple the central mandrel to the production tubing section; and a bottom hole assembly is hung from the production tubing conversion device below the downhole end of the production tubing section, wherein the bottom hole assembly is mechanically and fluidly coupled to the production tubing section through the production tubing conversion device.

* * * * *